United States Patent [19]

Meta

[11] Patent Number: 4,617,696

[45] Date of Patent: Oct. 21, 1986

[54] SCRAPER AND SCRUBBER FOR FRUITS, VEGETABLES AND THE HUMAN BODY

[76] Inventor: Frank Meta, P.O. Box 116, Irvington, N.J. 07111

[21] Appl. No.: 757,042

[22] Filed: Jul. 19, 1985

Related U.S. Application Data

[63] Continuation-in-part of Ser. No. 723,299, Apr. 15, 1985, which is a continuation-in-part of Ser. No. 519,104, Aug. 1, 1983, abandoned.

[51] Int. Cl.[4] ..... A61H 37/00; A23N 7/00

[52] U.S. Cl. ..... 15/236 R; 15/105

[58] Field of Search ..... 15/236 R, 105, 110, 15/222, 245; 128/57, 62 R; D24/36; 17/16, 19

[56] References Cited

U.S. PATENT DOCUMENTS

| | | | |
|---|---|---|---|
| D. 256,841 | 9/1980 | Corbett et al. | D24/36 |
| 899,365 | 9/1908 | Westrup | 15/236 R |
| 2,169,206 | 8/1939 | Krongold | 15/245 |
| 2,689,369 | 9/1954 | Biek | 15/245 |

*Primary Examiner*—Edward L. Roberts

*Attorney, Agent, or Firm*—David A. Jackson; Daniel H. Bobis

[57] ABSTRACT

A scraper and scrubber includes a hollow, elongated cylindrical body having an outer surface; a plurality of parallel, circumferentially spaced, V-shaped channels having a first depth extending in the longitudinal direction on the outer surface to form a plurality of parallel, circumferentially spaced ridges extending in the longitudinal direction on the outer surface between adjacent channels; a plurality of V-shaped helical grooves having a second, smaller depth extending at an acute angle to the channels and intersecting the ridges to form pointed, substantially pyramid shaped structures on the ridges, the substantially pyramid shaped structures formed on each ridge being offset with respect to the substantially pyramid shaped structures formed on adjacent ridges.

8 Claims, 7 Drawing Figures

SCRAPER AND SCRUBBER FOR FRUITS, VEGETABLES AND THE HUMAN BODY

REFERENCE TO RELATED APPLICATIONS

This application is a Continuation-In-Part of U.S. patent application Ser. No. 723,299, filed Apr. 15, 1985 which, in turn, is a Continuation-In-Part of U.S. Pat. application Ser. No. 519,104, filed Aug. 1, 1983, now abandoned.

BACKGROUND OF THE INVENTION

The present invention relates generally to scraping and scrubbing devices and, more particularly, is directed to a device for scraping and scrubbing dirt, soil and skin from fruit, vegetables and the human body.

Devices for removing dirt, soil and skin from fruit, vegetables and the human body are well known in the art. For example, knives and peeling devices are known that remove the outer layer of skin and dirt on fruit and vegetables, such as carrots, potatoes, beets, turnips, papaya and the like. A problem with such devices, however, is that approximately 10% of the fruit and vegetable, other than the skin, is also removed. In addition, there is the problem of the user being cut through such use, and the knife or peeler sinking in sink water during cleaning of the same, causing further inconvenience.

In the case of a brush, sponge or cloth used for removing dirt and soil, there is the problem of the brush, sponge or cloth holding moisture for a long period of time, resulting in the multiplication of germs. Storage of the brush, sponge or cloth is also delayed because of the moisture retention.

In case of stone and like structures having a plurality of peaks on the outer surface thereof, which are used for removing dirt, soil and skin from fruit, vegetables and the human body, such devices will become soiled and dirty themselves, and to clean such devices is a cumbersome and time consuming task.

Some of the above devices are also wasteful to the extent that the entire device is not used for the scraping and scrubbing operation, that is, the above devices usually require a handle which is not used in the scraping and scrubbing operation.

OBJECTS AND SUMMARY OF THE INVENTION

Accordingly, it is an object of the present invention to provide a scraper and scrubber that can easily remove dirt, soil and skin from fruit, vegetables and the human body.

More particularly, it is an object of the present invention to provide a scraper and scrubber that will remove only the outer layer of skin and dirt on fruit and vegetables.

It is another object of the present invention to provide a scraper and scrubber that will remove dead cells of skin on the human body.

It is still another object of the present invention to provide a scraper and scrubber that allows for easy cleaning thereof.

It is yet another object of the present invention to provide a scraper and scrubber, that entire scraper and scrubber of which can be used for scraping and scrubbing.

It is a further object of the present invention to provide a scraper and scrubber that is relatively lightweight and will float in water.

It is a still further object of the present invention to provide a scraper and scrubber that is relatively inexpensive to manufacture and can be resharpened.

In accordance with an aspect of the present invention, a scraper and scrubber includes an elongated cylindrical body having an outer surface; a plurality of parallel, circumferentially spaced channels having a first depth extending in the longitudinal direction on the outer surface and a plurality of parallel, circumferentially spaced ridges extending in the axial direction on the outer surface between adjacent channels; and a plurality of substantially V-shaped helical grooves having a second, smaller depth extending at an acute angle to the channels and intersecting the ridges to form pointed, substantially pyramid shaped structures on the ridges, the substantially pyramid shaped structures formed on each ridge being offset with respect to the substantially pyramid shaped structures formed on adjacent ridges.

The above, and other, objects, features and advantages of the present invention will become readily apparent from the following detailed description of the preferred embodiments which is to be read in connection with the accompanying drawings.

DETAILED DESCRIPTION OF THE PREFERRED EMBODIMENTS

Figure 1:
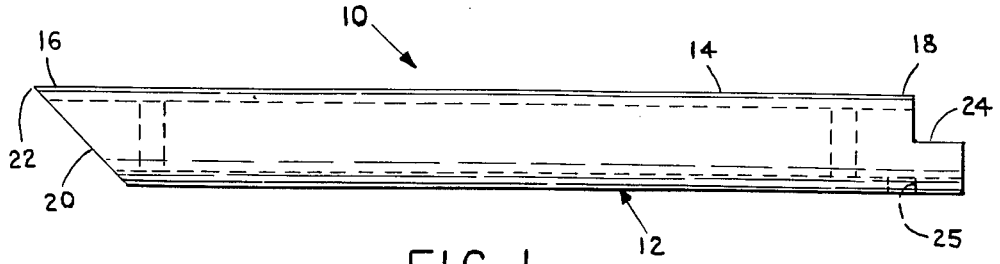
FIG. 1 is a side elevational view, showing the general configuration of a scraper and scrubber according to the present invention.
Figure 2:
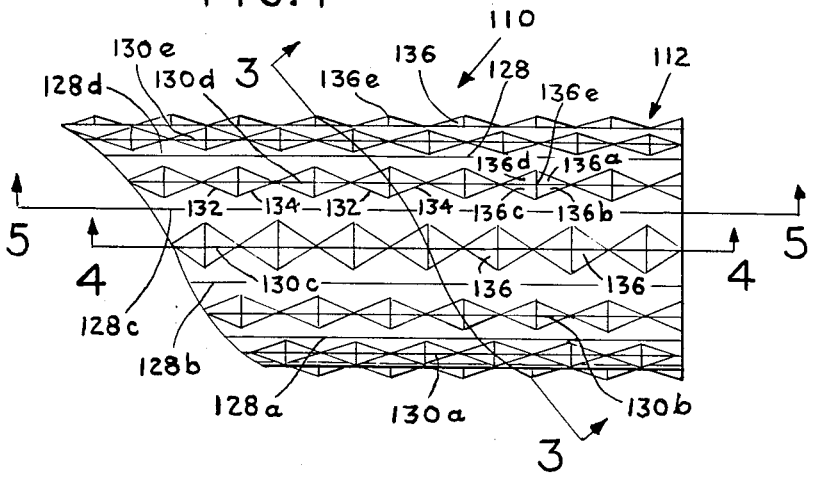
FIG. 2 is plan view of a portion of a scraper and scrubber according to a first embodiment of the present invention.

Referring to the drawings in detail, and initially to FIG. 1 thereof, the general configuration of a scraper and scrubber 10 according to the present invention is shown. Scraper and scrubber 10 includes an elongated, hollow cylindrical body 12 having an outer surface 14. Cylindrical body 12 may be of any diameter capable of being comfortably grasped in the user's hand. For example, cylindrical body 12 may have a diameter of 0.75 of an inch, which is large enough to allow a firm grasp without being so large as to be cumbersome during use. Cylindrical body 12 may be any convenient length, sufficient to provide ease of use. For example, a length of eight to sixteen inches is sufficient for purposes of the present invention.

Cylindrical body 12 has a first end 16 and a second, opposite end 18. First end 16 is cut at an angle to the longitudinal direction of cylindrical body 12, to define an angled end face 20, which forms a slanted end 22. Second end 18 is cut away to form a notch 24. Since cylindrical body 12 is hollow, plugs 26 are inserted within cylindrical body 12 adjacent first end 16 and second end 18. As a result, an air pocket is formed within cylindrical body 12, whereby scraper and scrubber 10 will float in a body of water.

Referring now to FIGS. 2–5, a portion of a scraper and scrubber 110 according to a first embodiment of the present invention will now be described, with elements identical to those already described with respect to the general configuration of FIG. 1 being identified by the same reference numerals augmented by 100. Scraper and scrubber 110 includes a plurality of parallel, circumferentially spaced, V-shaped channels 128 extending in the axial direction on outer surface 114, although channels 128 may assume other shapes, such as U-shaped or the like. Cylindrical body 112 has a wall thickness sufficient to accommodate channels 128. For example, channels 128 may have a depth of 0.04 inch which is sufficient, while maintaining a structural strength and rigidity for purposes of the present invention. In this regard, a plastic, metal or other suitable material having a cylindrical tubular configuration with a wall thickness of 1/16 inch can be used, although other wall thicknesses may be used and are within the scope of the present invention. As shown, channels 128 form a plurality of parallel, circumferentially spaced sharp ridges 130 extending in the axial direction on outer surface 114 between adjacent channels 128. In order to better understand the present invention from the drawings, channels 128 and ridges 130 are designated in circumferential sequence by the letters a, b, c and so on.

Figure 3:
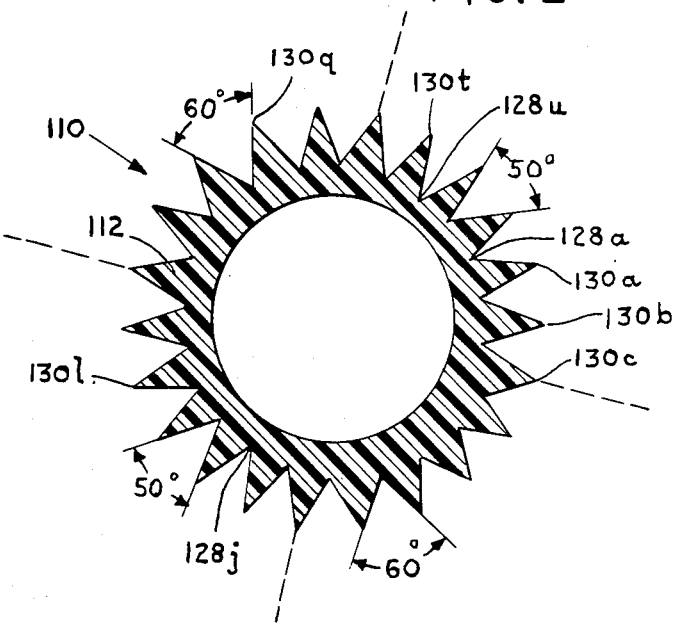
FIG. 3 is a cross-sectional view of the scraper and scrubber of FIG. 2, taken along line 3—3 thereof.

Further, as shown in FIG. 3, channels 128 are broken up into four quadrants spaced around the circumference of cylindrical body 112. Channels in opposing quadrants are formed with a first angle, for example, 60 degrees, while channels 128 in the remaining opposing quadrants are formed with a second, smaller angle, for example, 50 degrees. Channels 128 formed with the larger angle 60 degrees provides a rougher scraping and scrubbing action than channels 128 formed with the smaller angle 50 degrees. In this manner, as scraper and scrubber 110 is used, a slight rotational motion occurs, which results in a rougher scraping and scrubbing action followed by a finer scraping and scrubbing action.

Figure 4:
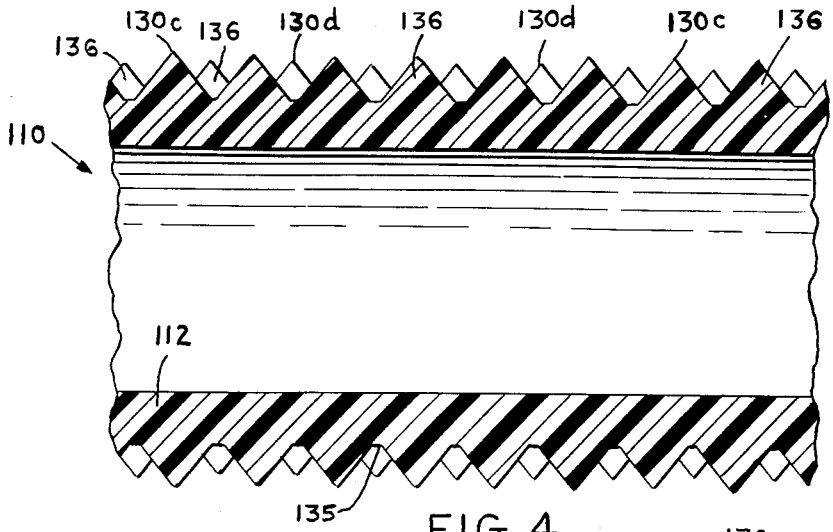
FIG. 4 is a cross-sectional view of the scraper and scrubber of FIG. 2, taken along line 4—4 thereof.
Figure 5:
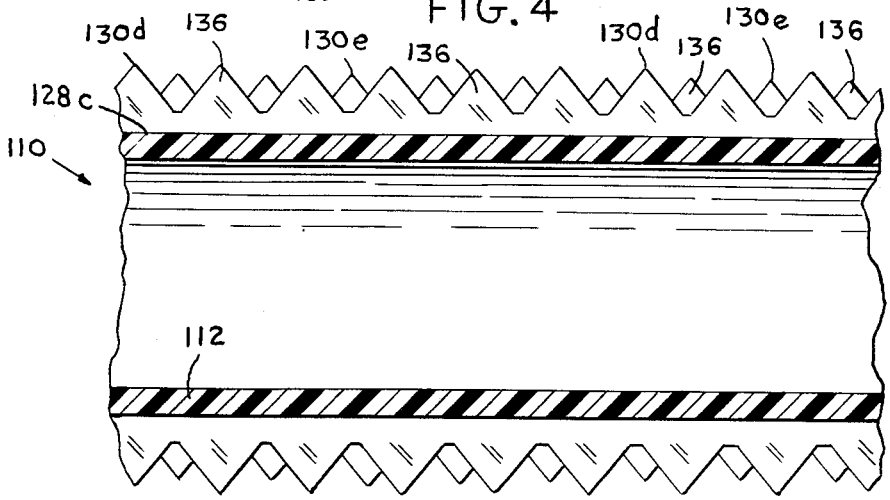
FIG. 5 is a cross-sectional view of the scraper and scrubber of FIG. 2, taken along line 5—5 thereof.

In accordance with the first embodiment of the present invention, a first plurality of substantially V-shaped helical grooves 132 are formed on outer surface 114, extending at an acute angle to channels 128 and intersecting ridges 130. A second plurality of substantially V-shaped helical grooves 134 are also formed on outer surface 114, extending at an acute angle in the opposite direction to channels 128 so as to criss-cross helical grooves 132 and intersect ridges 130. In actuality, the V-shaped grooves 132 and 134 have a flat bottom section 135, as shown in FIGS. 4 and 5. For example, first plurality of helical grooves 132 can be formed with a right hand thread, while second plurality of helical grooves 134 can be formed with a left hand thread. As an example, the pitch of the groove thread may be one inch per turn with a die. Helical grooves 132 and 134 have a smaller depth than channels 128, for example, one half the depth of channels 128, as shown in FIG. 5. As a result, pointed, substantially pyramid shaped structures 136 are formed on the ridges 130, with substantially pyramid shaped structures 136 formed on each ridge 130*a*, 130*c*, 130*e* and so on being offset or staggered with respect to substantially pyramid shaped structures 136 formed on adjacent ridges 130*b*, 130*d*, 130*f* and so on. Substantially pyramid shaped structures 136 include four sides 136*a*, 136*b* 136*c* and 136*d* formed by V-shaped grooves 132 and 134 intersecting ridges 130. Because ridges 130 are intersected from two sides, the four sides 136*a*, 136*b*, 136*c* and 136*d* converge at a central pointed peak 136*e*.

It is to be noted that the number and profile of channels and helical grooves, can vary to change the number, size and spacing of the substantially pyramid shaped structures 136.

In use, the user designates any end of the scraper and scrubber as the handle, grasps it, and contacts a fruit, vegetable or the human body with the remainder thereof. The scraper and scrubber is moved along the surface of the fruit, vegetable or human body in a direction substantially perpendicular to the longitudinal direction of the cylindrical body in a stroking manner, removing scraped material with each stroke.

To use the scraper and scrubber as a skinner, one holds the vegetable in one hand and the scraper and scrubber in the other hand, with the thumb resting on the end of the vegetable, as in skinning a potato. Each stroking scrape is guided by the thumb as drops of water fall on the potato and the scraper and scrubber. The scraped skin of the potato will fall with the drops of water. The eyes of the potato are removed by the slanted end or the notched end of the scraper and scrubber. Thereafter, the skinned vegetable is rinsed, and it can then be cooked and served with all the valuable nutrients thereof.

To scrub dirt or soil from the fruit or vegetable, one holds the fruit or vegetable in one hand and the scraper and scrubber in the other hand, and with less pressure, scrubs the fruit or vegetable with the scraper and scrubber under running water.

For a fruit or vegetable, only the outer layer of skin, dirt or soil is removed, while for the human body, dead cells of skin are removed. To use the scraper and scrubber as a face or body scrubber, one uses soap and water and scrubs the face or body with the scraper and scrubber in the morning when washing one's face or taking a bath or shower. For example, after soap is applied in a shower, the scraper and scrubber is used to remove the soap and dead cells of skin. The scraper and scrubber hastens the removal of soap and dead cells of skin, in comparison to the mere use of water for such removal, thereby saving water when taking a shower. Hard to reach places can be scrubbed with the slanted end of the scraper and scrubber, for example, between the toes. The scraper and scrubber can be used for soft, tender parts of the body, such as the tongue, to remove saliva residue therefrom which may stick to the taste buds.

To stimulate the circulation or to alleviate discomfort from prolonged standing or walking, one rubs the part of the body where stimulation is desired with the scraper and scrubber.

The scraper and scrubber can be washed with soap and water and conveniently dried with a towel and stored by simply hooking it up on a rack through a hole 25 (FIG. 1) or placed in a drawer.

It is to be noted that the substantially pyramid shaped structures 136 formed in adjacent ridges 130 be offset from each other to provide greater efficiency in the scraping operation, while also providing a sort of self cleaning operation during use. Specifically, the helical grooves 132 and 134 which form the offset substantially pyramid shaped structures, provides that water and soap, during use and cleaning, travel around the helical grooves and thereby do not remain on the scraper and scrubber 110. It is to be noted that, if the grooves and channels are of the same depth, and the grooves are not helical, but rather, extend perpendicular to channels 128, soap residue and the like would form on the side walls of any substantially pyramid structures formed by the grooves, since the water would not run off the device, as with the present invention. It is essential to provide the offset substantially pyramid shaped structures 136 so that there are no gaps formed during the scraping and scrubbing operation.

In cleaning scraper and scrubber 110, a brush is used in the direction of channels 128, thereby making it easier to clean, since channels 128 have a greater depth than grooves 132 and 134. During cleaning of the scraper and scrubber, the bristles of a brush will move in a slanted, side to side manner in channels 128, and will thereby clean grooves 132 and 134. It is to be noted, from an operational standpoint, if the grooves are of the same depth as the channels, the substantially pyramid shaped structures that would be formed will tear or rip a fruit, vegetable or the skin of a human body, rather that scrape the same, because the spacing of ridges and the depth of channels would have to be substantial.

Figure 6:
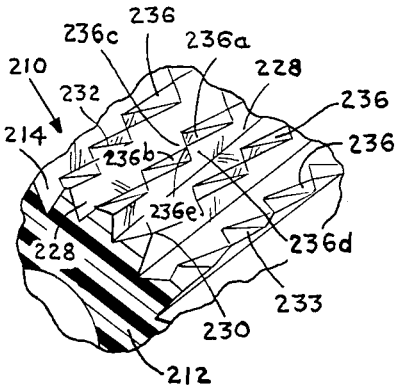
FIG. 6 is perspective view of a portion of a scraper and scrubber according to a second embodiment of the present invention.
Figure 7:
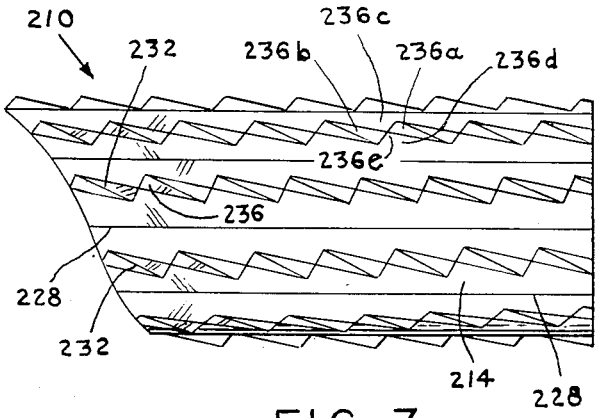
FIG. 7 is a plan view of a portion of the scraper and scrubber of FIG. 6.

Referring now to FIGS. 6 and 7, a portion of a scraper and scrubber 210 according to a second embodiment of the present invention will now be described, with elements identical to those already described with respect to the general configuration of FIG. 1 being identified by the same reference numerals augmented by 200 and with elements identical to those already described with respect to the first embodiment of FIGS. 2–5 being identified by the same reference numerals augmented by 100. In accordance with the second embodiment, scraper and scrubber 210 includes a plurality of parallel, circumferentially spaced, V-shaped channels 228 extending in the axial direction on outer surface 214. As shown, channels 228 form a plurality of parallel, circumferentially spaced, sharp ridges 230 extending in the axial direction on outer surface 214 between adjacent channels 228.

In accordance with the second embodiment of the present invention, a first plurality of V-shaped helical grooves 232 are formed on outer surface 214, extending at an acute angle to channels 228 and intersecting ridges 230. Helical grooves 232 have a smaller depth than channels 228, for example, one half the depth of channels 228, as shown in FIG. 6. As a result, pointed, substantially pyramid shaped structures 236 are formed on ridges 230, with substantially pyramid shaped structures 236 formed on each ridge 230 being offset or staggered with respect to substantially pyramid shaped structures 236 formed on adjacent ridges 230. Substantially pyramid shaped structures 236 include two sides **236*a* and 236*b* formed by V-shaped grooves 232 intersecting ridges 230 and two sides 236*c* and 236*d*** *formed, by the sides of adjacent channels 228, as shown in FIG. 6. Because ridges 230 are sharp, the four sides 236a,* **236*b* 236*c* and 236*d* converge at a central pointed peak 236*e***. It is to be noted that the second embodiment differs from the first embodiment by the formation of grooves in a single direction, for example, a right hand thread only, while the first embodiment includes grooves formed by right and left hand threads.

It is to be noted that the number and profile of channels and helical grooves, can vary to change the number, size and spacing of the substantially pyramid shaped structures 236.

Having described specific preferred embodiments of the invention with reference to the accompanying drawings, it is to be noted that the present invention is not limited to those specific embodiments, and that various changes and modifications may be effected by one of ordinary skill in the art without departing from the spirit and scope of the present invention as defined by the appended claims.

What is claimed is:

1. A scraper and scrubber, comprising:

an elongated cylindrical body having an outer surface;

a plurality of parallel, circumferentially spaced channels having a first depth extending in the longitudinal direction on said outer surface to form a plurality of parallel, circumferentially spaced ridges extending in the longitudinal direction on said outer surface between adjacent channels;

a plurality of substantially V-shaped helical grooves having a second, smaller depth extending at an acute angle to said channels and intersecting said ridges to form sharp, substantially pyramid shaped structures on said ridges, said substantially pyramid shaped structures situated on each ridge being offset with respect to said substantially pyramid shaped structures situated on adjacent ridges.

2. A scraper and scrubber according to claim 1; wherein a first plurality of parallel, substantially V-shaped helical grooves having said second, smaller depth extend at an acute angle to said channels in only a single direction and intersect said ridges to form said sharp, substantially pyramid shaped structures on said ridges.

3. A scraper and scrubber according to claim 2; wherein a second plurality of parallel, substantially V-shaped helical grooves having said second, smaller depth extend at an acute angle to said channels, crisscross said first plurality of parallel, substantially V-shaped helical grooves and intersect said ridges to form said sharp, substantially pyramid shaped structures on said ridges.

4. A scraper and scrubber according to claim 1; wherein said elongated cylindrical body has a first end and a second end, said first end cut at an angle to the longitudinal direction of said elongated cylindrical body, to define a slanted end.

5. A scraper and scrubber according to claim 1; wherein said elongated cylindrical body has a first end and a second end, said second end being cut away to define a notch.

6. A scraper and scrubber according to claim 1; wherein said elongated cylindrical body is hollow.

7. A scraper and scrubber according to claim 1; wherein said channels are substantially V-shaped.

8. A floatable and resharpenable scraper and scrubber prepared from a hard material for use on a porous elastic surface, comprising a cylindrical tube, plugged at each end, having on an outer surface a first plurality of parallel axial circumferentially spaced substantially V-shaped channels of a first depth extending between adjacent circumferentially spaced ridges, each ridge having in a single row a plurality of sharp peaks, spaced by a plurality of helical circumferentially situated substantially V-shaped grooves of a second smaller depth, and said grooves extending to said channels and helically intersecting said ridges.

* * * * *